US010682692B2

(12) United States Patent
Burns et al.

(10) Patent No.: US 10,682,692 B2
(45) Date of Patent: Jun. 16, 2020

(54) METHOD FOR PROVIDING PREFORMED INTERNAL FEATURES, PASSAGES, AND MACHINING CLEARANCES FOR OVER-MOLDED INSERTS

(71) Applicant: Ford Motor Company, Dearborn, MI (US)

(72) Inventors: Jonathan Burns, Windsor (CA); Robert Rentschler, Dearborn, MI (US); Bryan McKeough, Macomb, MI (US); Cliff Maki, New Hudson, MI (US); Kevin Byrd, Novi, MI (US)

(73) Assignee: Ford Motor Company, Dearborn, MI (US)

( * ) Notice: Subject to any disclaimer, the term of this patent is extended or adjusted under 35 U.S.C. 154(b) by 200 days.

(21) Appl. No.: 15/864,968

(22) Filed: Jan. 8, 2018

(65) Prior Publication Data

US 2019/0210100 A1 Jul. 11, 2019

(51) Int. Cl.

| | |
|---|---|
| ***B22D 19/00*** | (2006.01) |
| ***B22D 19/16*** | (2006.01) |
| ***B22D 17/24*** | (2006.01) |
| ***B22C 9/10*** | (2006.01) |
| ***B22D 29/00*** | (2006.01) |
| ***F02F 7/00*** | (2006.01) |

(52) U.S. Cl.

CPC ..... *B22D 17/24* (2013.01); *B22C 9/10* (2013.01); *B22D 19/00* (2013.01); *B22D 19/0009* (2013.01); *B22D 19/16* (2013.01); *B22D 29/001* (2013.01); *F02F 7/0021* (2013.01); *F02F 7/0053* (2013.01); *F02F 2200/06* (2013.01); *F05C 2201/021* (2013.01)

(58) Field of Classification Search

CPC ..... B22D 19/00; B22D 19/0009; B22D 19/0018; B22D 19/0027; B22D 19/0072; B22D 19/16

See application file for complete search history.

(56) References Cited

U.S. PATENT DOCUMENTS

| | | | | |
|---|---|---|---|---|
| 6,478,073 | B1 | 11/2002 | Grebe et al. | |
| 8,574,476 | B2 | 11/2013 | Yamada | |
| 9,086,031 | B2 | 7/2015 | Williams et al. | |
| 2005/0082028 | A1* | 4/2005 | Akaba | B22C 9/10 164/98 |
| 2015/0060005 | A1 | 3/2015 | Hartig | |
| 2016/0069249 | A1* | 3/2016 | Youm | B22C 9/105 123/41.72 |

FOREIGN PATENT DOCUMENTS

| | | | | |
|---|---|---|---|---|
| FR | 2786418 | A1 * | 6/2000 | B22D 19/04 |

* cited by examiner

*Primary Examiner* — Kevin E Yoon
(74) *Attorney, Agent, or Firm* — Burris Law, PLLC

(57) ABSTRACT

A method of casting an assembly is provided that includes forming a structural insert, over-molding the structural insert with a temporary core, and positioning the over-molded structural insert within a cavity of a casting die. The over-molded structural insert is cast within a part, to form the assembly, and the temporary core is removed. The method may also include a temporary core configured to define an alloy flash trim location or locating features to position the structural insert within the cavity of the casting die. Further, the temporary core may define shared features with the structural insert. The part and structural insert may be dissimilar materials such as a part of an aluminum alloy material and a structural insert of a steel alloy material.

17 Claims, 9 Drawing Sheets

METHOD FOR PROVIDING PREFORMED INTERNAL FEATURES, PASSAGES, AND MACHINING CLEARANCES FOR OVER-MOLDED INSERTS

FIELD

The present disclosure relates to methods of casting, and more particularly to methods of casting different components together to form an assembly.

BACKGROUND

The statements in this section merely provide background information related to the present disclosure and may not constitute prior art.

Demands for improved performance and fuel economy, as well as reduced cost, waste, and logistical footprints are driving automotive component designs. Recently, multi-material designs have been introduced to leverage the benefits of different materials as desired within a single part. An example is a recent development in the over-molding of structural load-bearing steel inserts with a lighter weight aluminum alloy to produce a compact, lightweight cylinder block (part) that is capable of sustaining increased combustion loading as disclosed in in U.S. Pat. No. 9,086,031, which is commonly assigned with the present application and incorporated herein by reference in its entirety.

In a single material part, geometric features may be produced with a combination of cast features and machined features to deliver the final part design. In the case of over-molded parts, subsequent machining operations may require machining multiple materials or machining a difficult-to-machine material. Continuing with the cylinder block example above, the load-bearing steel insert may be made of a powder forged and sintered material that is difficult to machine and would require a bearing oil feed to be drilled after the casting operation.

Another challenge in the over-molding of inserts is the dimensional tolerances between the insert and the casting mold or tool. Again, citing the cylinder block example above, the steel insert must be retained in the casting mold during the casting process. There will therefore be some regions designed with contact or close-proximity between the steel insert and the casting tool. Due to practical limitations, such as machining variation and dimensional change due to thermal expansion of the insert and/or the casting mold, there may be local areas within the contact regions with no physical contact between the insert and the mold, namely, a gap. Molten alloy can easily flow into this gap and generate a thin layer referred to as flash on the cast part. This flash is shown in FIGS. 1A and 1B, which illustrates a steel insert with a temporary core, an aluminum casting, and flashing from a conventional High Pressure Die Cast (HPDC) process. If the insert surface is geometrically complex, the flash can fully encase a portion of the insert, and removing the flash may be quite difficult without either damaging the insert, the part, or introducing expensive and difficult bi-metallic machining operations.

The present disclosure addresses the challenges of casting multiple parts of different materials within an assembly, among other issues related to casting such assemblies.

SUMMARY

In one form of the present disclosure, a method of casting an assembly is provided that comprises forming a structural insert, over-molding the structural insert with a temporary core, and positioning the over-molded structural insert within a cavity of a casting die. The over-molded structural insert is cast within a part, to form the assembly, and the temporary core is removed.

In a variation of this method, the part is an engine block, and the temporary core completely fills a crank journal of the structural insert. In other variations, the temporary core fills an oil feed hole within the structural insert, the oil feed hole is formed in the structural insert in a green state, and the structural insert is subsequently processed to achieve predetermined mechanical properties.

In another variation, the temporary core is configured to define at least one of an alloy flash trim location, locating feature(s) to position the structural insert within the cavity of the casting die, shared feature(s) with the structural insert, and combinations thereof. With additional variations, the temporary core is soluble, the casting comprises high pressure die casting (HPDC), the structural insert is a steel alloy material, the structural insert does not undergo any post-processing to remove metal from the casting step after removing the temporary core, and the part is an aluminum alloy material.

According to another variation, a plurality of temporary cores are configured to define at least one functional feature for subsequent manufacturing operations. In still another form, a plurality of temporary cores and a plurality of structural inserts form a plurality of over-molded structural inserts, wherein the plurality of over-molded structural inserts are cast within the part to form the assembly.

According to another form of the present disclosure, a method of casting an assembly is provided that comprises forming a structural insert with geometric features in a green state, processing the structural insert to achieve predetermined mechanical properties, and over-molding the structural insert with a temporary core such that the temporary core fills the geometric features. the over-molded structural insert is positioned within a cavity of a casting die and cast within a part to form the assembly and the temporary core is removed.

In variations of this method, the assembly is an engine block and the geometric features are selected from the group consisting of a crank journal, an oil feed hole, bolt pilot holes, a thrust face, a face having a casting draft, and internal fluid passageways.

In still another form of the present disclosure, a method of forming an assembly is provided that comprises forming an insert and over-molding the insert with a temporary core that defines functional features for subsequent manufacturing operations. Then, the over-molded insert is formed within a part to form the assembly and the temporary core is removed. In a variation of this method, the insert does not undergo any post-processing to remove material after removing the temporary core.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1A:
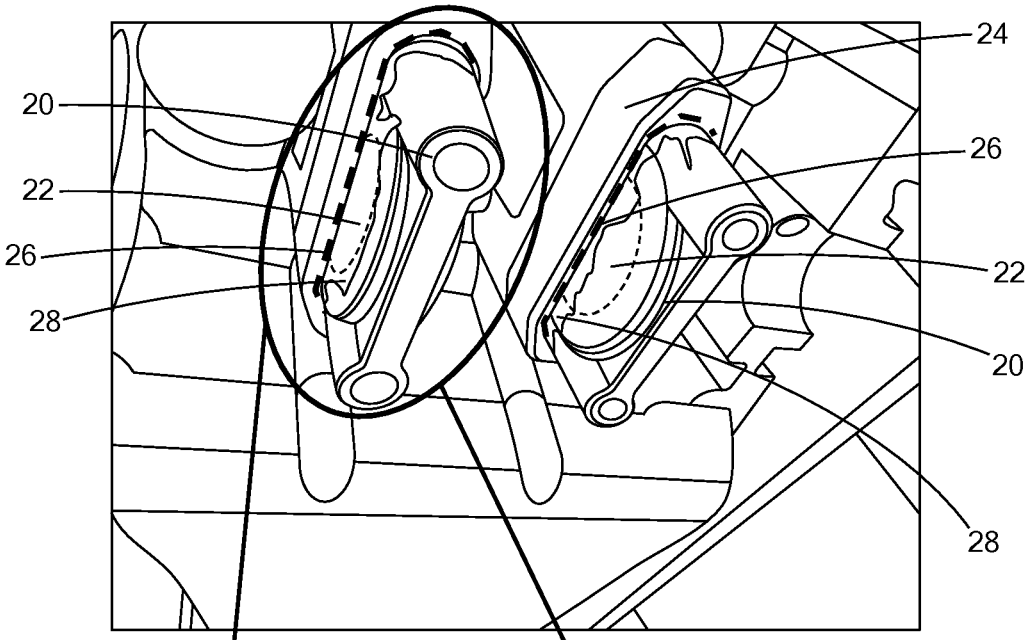
FIG. 1A Prior Art
FIG. 1A is a photograph of a cast-in insert with flashing, according to the prior art.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Throughout the present disclosure the phrase "casting die" should be construed to mean casting molds and their equivalents, as the present disclosure is applicable to a variety of casting equipment and processes.

Figure 1B:
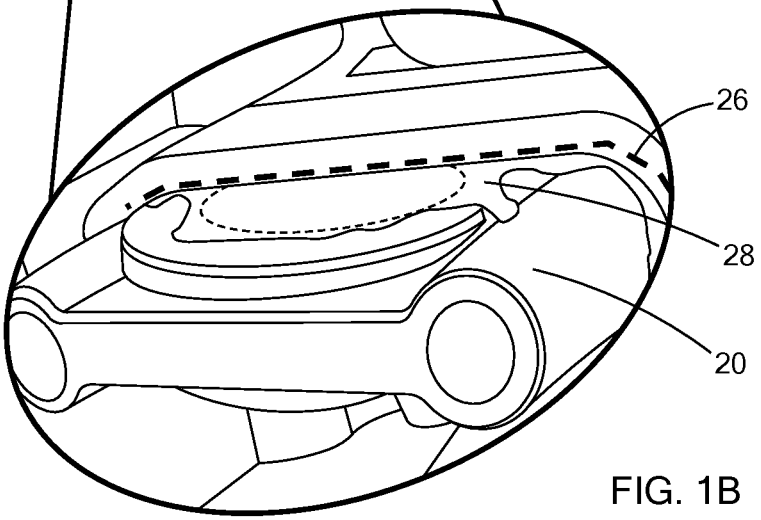
FIG. 1B Prior Art
FIG. 1B is an enlarged view of FIG. 1A.

Referring to FIGS. 1A and 1B, a steel insert 20 is illustrated that includes a removable aluminum core 22 with an aluminum casting 24 around the steel insert 20 according to the prior art. A casting boundary 26 is between the steel insert 20, removable and soluble core 22, and the aluminum casting 24. The aluminum casting 24 includes a flash portion 28 (or flash), which is removed in a subsequent manufacturing operation. Removing the flash can be challenging without either damaging the steel insert 20, the aluminum casting 24, or introducing expensive and difficult bi-metallic machining operations.

Figure 2B:
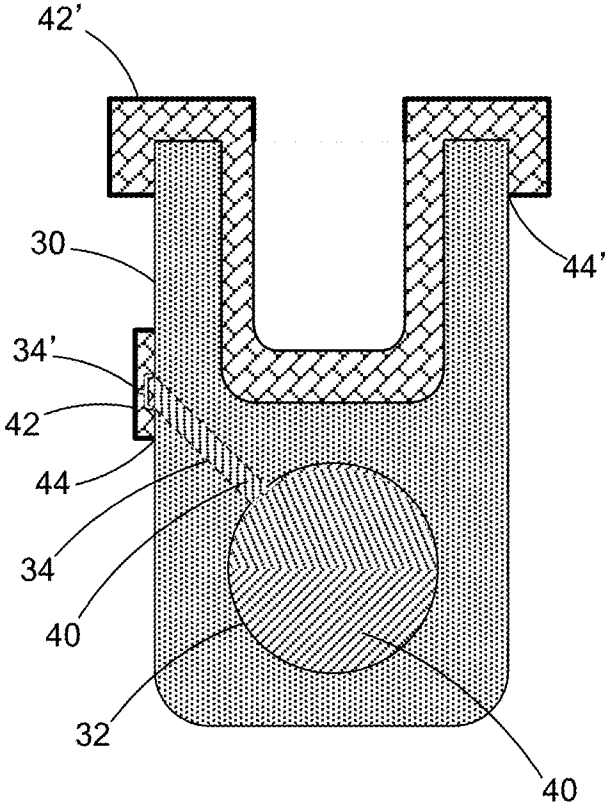
FIG. 2B is a side cross-sectional view of FIG. 2A with a temporary core filling some internal features and temporary core over-molding filling/covering some external features, according to the teachings of the present disclosure.
Figure 2A:
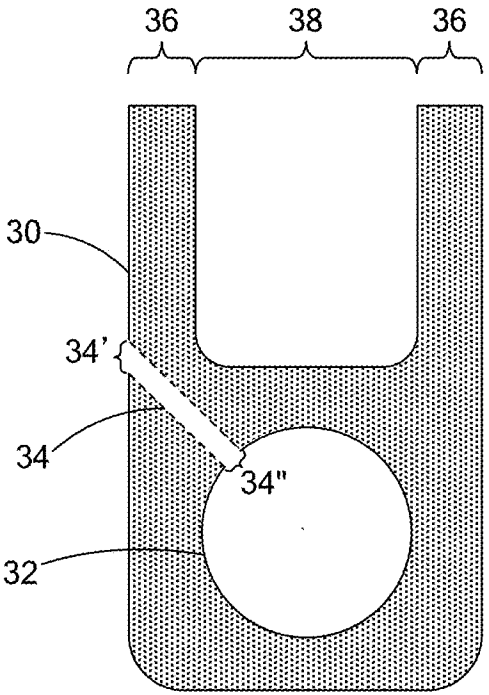
FIG. 2A is a side cross-sectional view of an insert, with exemplary external and internal features according to the teachings of the present disclosure.

Referring to FIGS. 2A-2B, to alleviate this issue of flashing, among other casting challenges with inserts, the present disclosure provides an insert 30 having an insert cavity 32, an insert internal passageway 34, ribs 36, and a port 38 disposed between the ribs 36. The insert internal passageway 34 has an insert opening 34' and an insert cavity opening 34". In FIG. 2B, insert cavity 32 and insert internal passageway 34 have been filled with a first temporary core 40, and the insert opening 34' and the ribs 36 and port 38 have been covered with a temporary core over-molding 42 and 42', respectively. For ease of viewing, the temporary core over-molding 42 and 42' has a different cross-sectional hatching pattern than first temporary core 40, however, temporary core over-molding 42 and 42' and first temporary core 40 may be the same material.

Referring to the internal passageway 34, the temporary core over-molding 42 allows the flash trim location 44 to be moved away from insert opening 34', enabling the flash to be removed in a non-structural location, or in a location that is less likely to cause damage to the insert 30. The temporary core over-molding 42 also covers the ribs 36 and port 38 surface as shown, which in one form can provide a surface that is a datum "A" for subsequent assembly/manufacturing operations. Generally, the ribs 36 are used to align the insert 30 within the casting mold or die cavity, and thus their surfaces would provide a locating feature, or datum for proper location/placement within the casting mold/die.

Rather than only filling internal apertures for geometric features such as the internal passageway 34, the temporary core over-molding 42 covers the insert 30 in other areas to define functional features for subsequent manufacturing operations. These functional features include, by way of example, flash trim locations, datums, and quality control registration points/locations, among others. Additionally, the temporary core over-molding 42 can be configured to provide additional geometric features, which are also described in greater detail below.

Figure 3A:
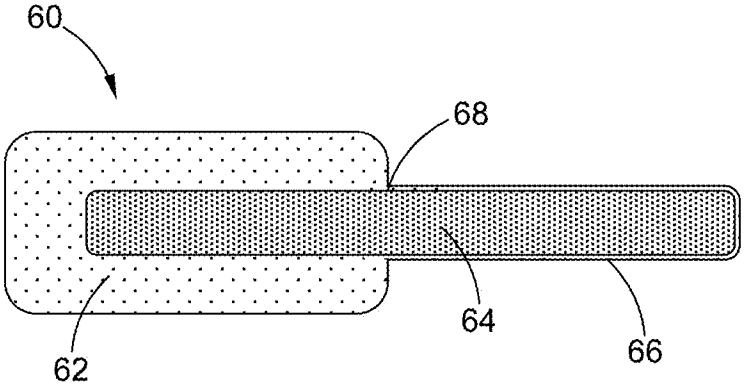
FIGS. 3A-3C illustrate an exemplary method of improving flash processing, according to the teachings of the present disclosure.
Figure 3B:
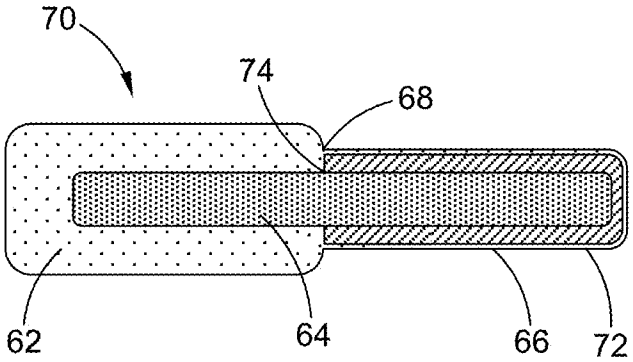
Figure 3C:
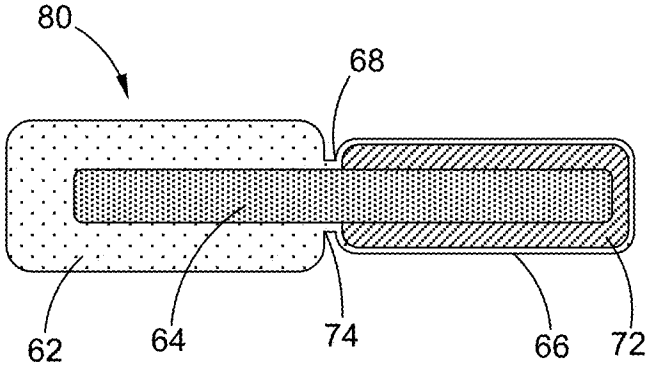

More specifically with respect to the flash trim locations, and referring to FIGS. 3A-3C, a composite casting assembly 60 includes a casting material 62 cast to an insert 64, and the insert 64 is at least partially encapsulated by excess flash material 66. Where the casting material 62, insert 64, and flash material 66 meet defines a flash trim location 68. The flash trim location 68 is where a post-processing procedure (e.g., machining) is to remove the flash material 66 from the composite casting assembly 60.

Now referring to FIGS. 3B and 3C, a temporary core 72 has at least partially encapsulated the insert 64 to define a dedicated trim location 68. As such, non-locating features of the insert 64 are completely encased by the temporary core 72. As such, when cast in a die operation, any flash would be present between the casting mold/die and the temporary core 72 rather than directly adjacent the insert 64. In this manner, thin flash can be removed in a temporary core removal process or more easily machined in subsequent operations as the flash is offset from the surface of the hard insert 64 and projected away from an interface between the casting material 62 and the insert 64 interface at a large angle.

Also shown in FIGS. 3B and 3C is a functional feature 74, which in this example may be a datum from which other parts are located in subsequent assembly operations, or a quality control registration point/location.

Figures 4A, 4B, 4C:
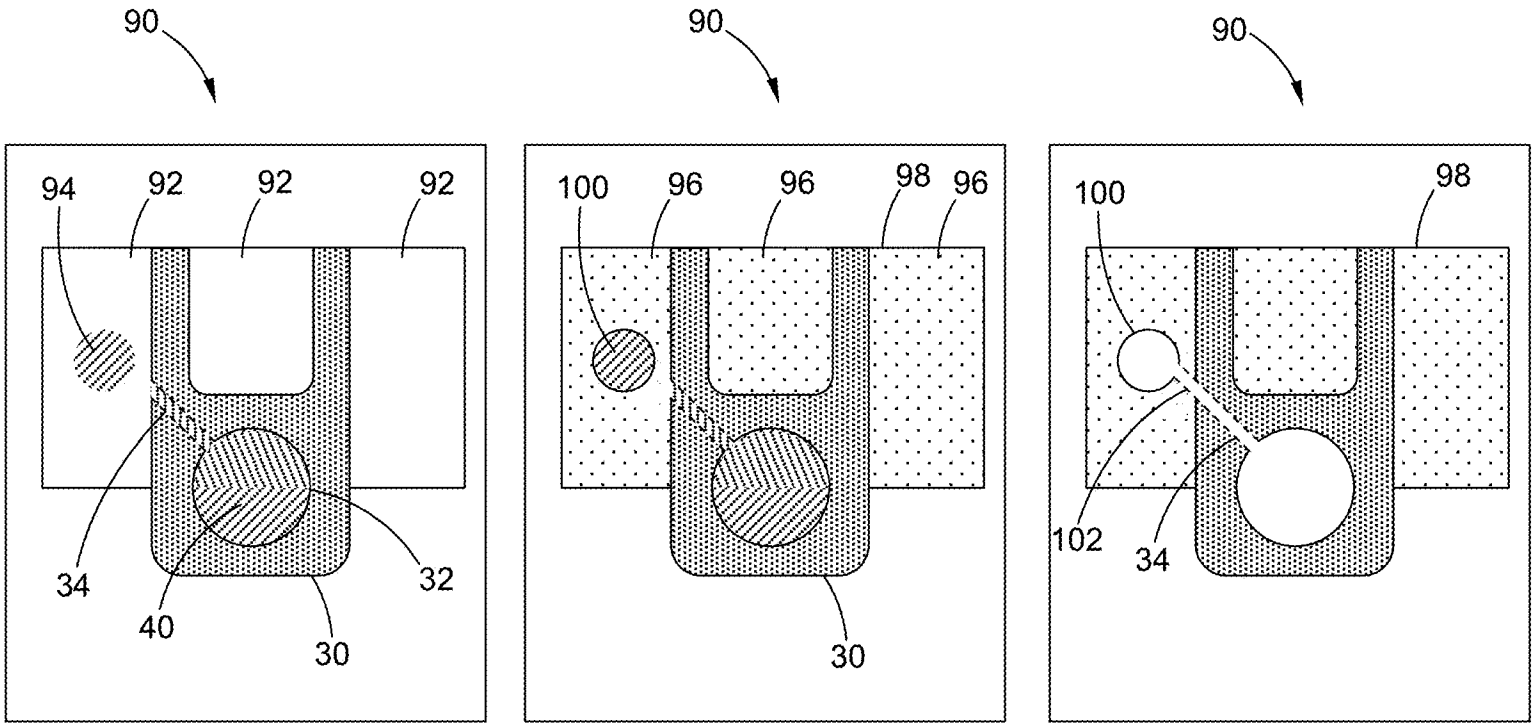
FIG. 4A is a side cross-sectional view illustrating an exemplary insert and over-molded temporary core within a casting mold prior to casting, according to the teachings of the present disclosure.
FIG. 4B is a side cross-sectional view illustrating the insert of FIG. 3A after casting, according to the teachings of the present disclosure.
FIG. 4C is a side cross-sectional view illustrating the insert of FIG. 3B after removal of the temporary core and optional machining or finishing operations, according to the teachings of the present disclosure.

Referring to FIG. 4A, prior to casting, a casting die 90 has a die cavity 92 with the insert 30 disposed therein. The insert cavity 32 and insert internal passageway 34 have been filled with a first temporary core 40, a second core 94 (which may or may not be temporary) has been placed within die cavity 92. In this form, the second core 94 is temporary and defines a supplemental geometric feature desired within the casting assembly, such as by way of example a fluid passageway.

Referring to FIG. 4B, a casting material 96 is cast into the die cavity 92, forming a casting assembly 98. In this form, casting assembly 98 includes supplemental geometric feature 100. Supplemental geometric feature 100 may or may not be created by a temporary core such as second temporary core 94.

Referring now to FIG. 4C, first temporary core 40 and second temporary core 94 have been removed from casting assembly 98, and post-processing has removed material to form a channel 102 connecting insert internal passageway 34 and the supplemental geometric feature 100.

Figure 5B:
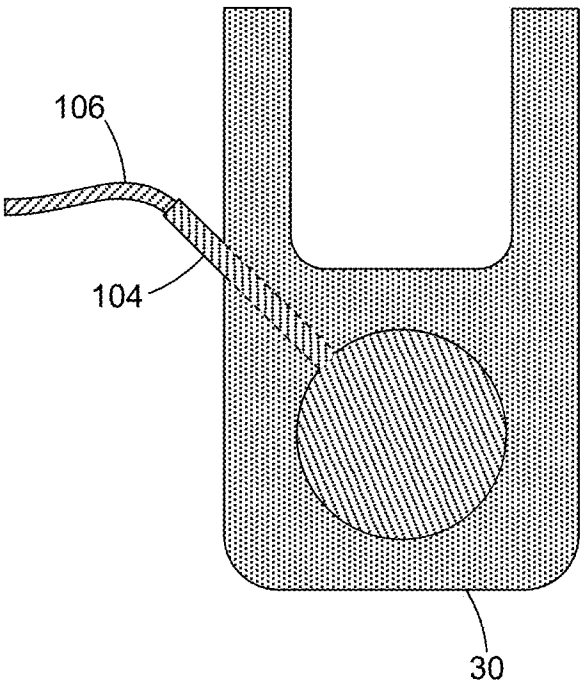
FIG. 5B is a side cross-sectional view illustrating the insert of FIG. 5A with an exemplary complex shape on the over-molded temporary core extending outside the insert, according to the teachings of the present disclosure.
Figure 5A:
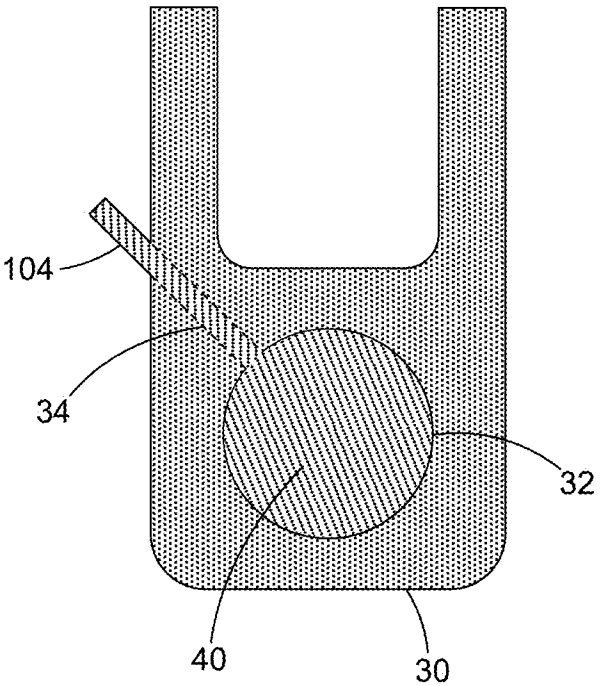
FIG. 5A is a side cross-sectional view illustrating an exemplary insert and over-molded temporary core extending outside the insert, according to the teachings of the present disclosure.

In another form as shown in FIGS. 5A-5B, the first temporary core 40 has been extended outside the insert 30 as a temporary core extension 104 of the insert internal passageway 34 towards another geometric feature (e.g. the second temporary core 94 or supplemental geometric feature 100 of FIGS. 4A-4C) within the casting assembly to reduce post-processing operations. For example, temporary core extension 104 could be used as a drill clearance passageway to avoid bi-metallic machining. In FIG. 5B, temporary core extension 104 has been coupled to a secondary temporary core extension 106. The secondary temporary core extension 106 provides yet another geometric feature, such as an oil feed passageway extension to completely eliminate post-machining operations. Accordingly, the temporary core extension 104 and the secondary temporary core 106 extension can reduce post-processing operations.

Figure 6B:
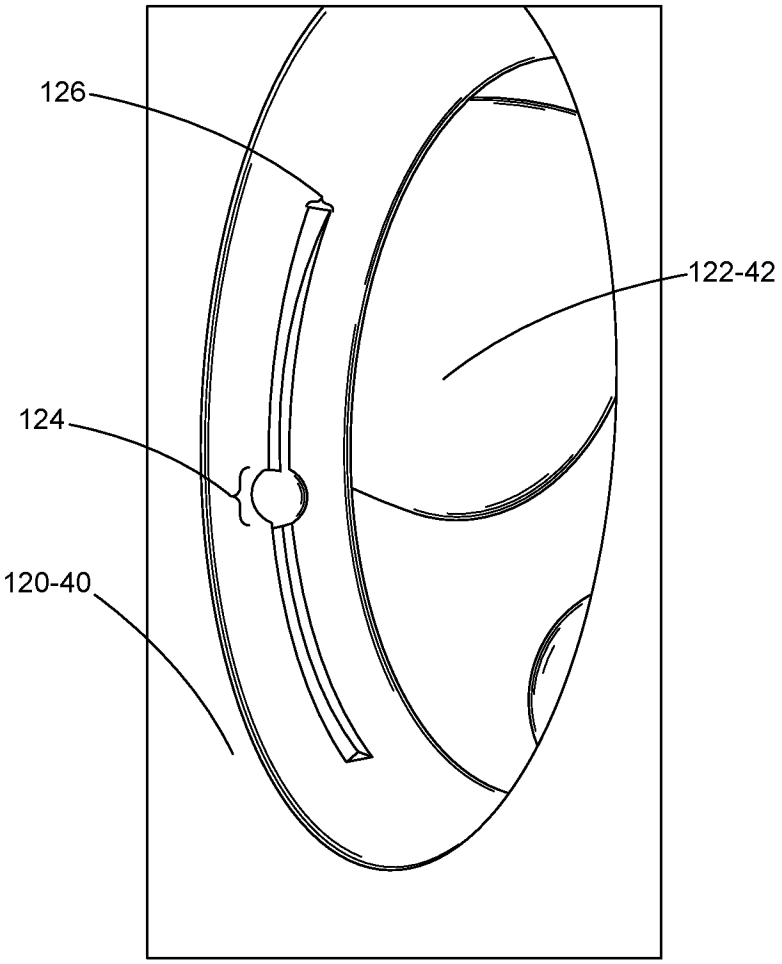
FIG. 6B is a photograph of an exemplary oil feed hole and channel over-molded into a main bearing journal ("crank journal") of FIG. 6A, according to the teachings of the present disclosure.
Figure 6A:
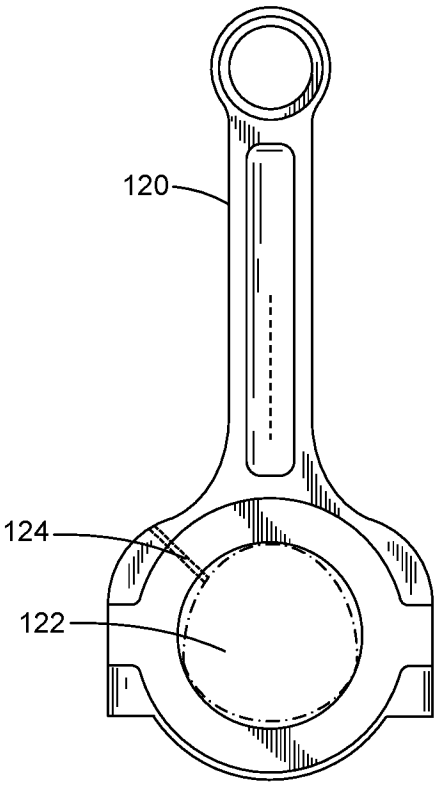
FIG. 6A is a side view of an exemplary cast connecting rod with an oil feed hole, according to the teachings of the present disclosure.

Referring now to FIGS. 6A-6B, and to demonstrate additional features that may be formed according to the methods of the present disclosure, a cast connecting rod 120 with a crank journal 122 (analogous to insert cavity 32 as illustrated above), which receives a main journal of a crankshaft, of an engine is shown. An oil feed 124 (analogous to insert internal passageway 34 as illustrated above) is connected to an oil feed channel 126 (analogous to insert cavity opening 34" as illustrated above) disposed within the crank journal 122. The oil feed 124 is in fluid communication with an oil gallery (not shown, but refer to supplemental geometric feature 100 as an example). The oil feed 124 and the oil feed channel 126 are both traditionally machined out of the cast connecting rod 120, which can be an expensive and time consuming process.

Rather than machining the oil feed 124 and oil feed channel 126, the present disclosure provides the temporary core to provide these features, which in one form are formed in a powder forged connecting rod in a green state prior to the connecting rod 120 being sintered. In one form, the oil feed hole 124 is formed in the structural insert in a green state, and the structural insert is subsequently processed to achieve predetermined mechanical properties. As used herein, the term "insert" should not be construed as limiting the teachings of the invention to the engine block insert illustrated herein. Instead, an "insert" may also be a part such as the connecting rod 120, or any part that is inserted into another component to form a composite casting assembly.

The present disclosure is not limited to sintered inserts and is applicable to other materials (e.g. alloys, ceramics, phenolics) that can withstand exposures to the desired conditions of casting processes, for example elevated temperatures in the HPDC process. In the case of alloys, the green state is prior to hardening. In the case of ceramics, the green state is prior to drying/baking. In the case of phenolics, the green state is prior to post bake or whenever full cure is established.

While the teachings of the present disclosure have been illustrated with respect to an insert 30 and a connecting rod 120 of an engine, it should be understood that the disclosure is applicable to a variety of cast components and assemblies and is not limited to those illustrated and described herein. Accordingly, the illustration and description of an insert 30 and a connecting rod 120 should not be construed as limiting the scope of the present disclosure.

Figure 7:
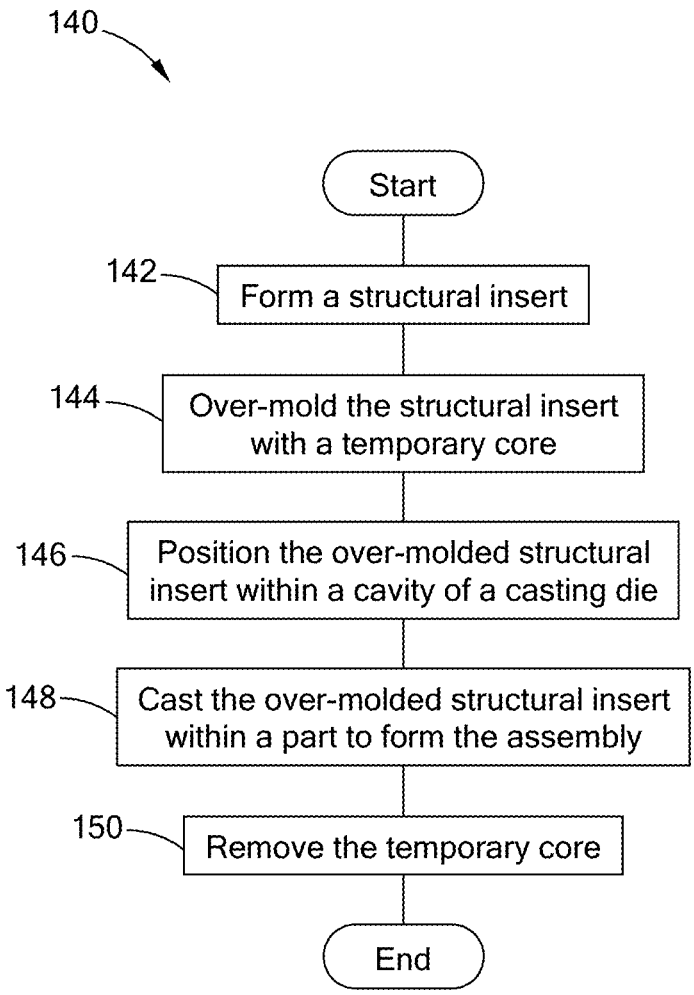
FIG. 7 is a flow chart illustrating one form of a method for casting an assembly, according to the teachings of the present disclosure.

Referring to FIG. 7, a method 140 of casting an assembly according to the teachings of the present disclosure is shown. The method 140 comprises forming a structural insert 142, over-molding the structural insert with a temporary core 144, and positioning the over-molded structural insert within a cavity of a casting die 146. The over-molded structural insert is cast within a part, to form the assembly 148, and the temporary core is removed 150.

In other methods of the present disclosure, the part is an engine block, and the temporary core fills various geometric features not limited to a crank journal, an oil feed hole, bolt pilot holes, a thrust face, a face having a casting draft, and internal fluid passageways. In variations of these methods, the assembly is a part, the insert has features, and the features are formed in the green state of the insert. The green state is subsequently processed to achieve predetermined properties (aesthetic, functional, mechanical, or structural).

In another method, the temporary core is configured to define at least one of an alloy flash trim location, locating feature(s) to position the structural insert within the cavity of the casting die, shared feature(s) with the structural insert, and combinations thereof. With additional methods, the temporary core is soluble, the casting comprises high pressure die casting (HPDC), the structural insert is a steel alloy material, the structural insert does not undergo any post-processing to remove metal from the casting step after removing the temporary core, and the part is an aluminum alloy material.

According to another method, a plurality of temporary cores are configured to define at least one functional feature for subsequent manufacturing operations. In still another method, a plurality of temporary cores and a plurality of structural inserts form a plurality of over-molded structural inserts, wherein the plurality of over-molded structural inserts are cast within the part to form the assembly.

Figure 8:
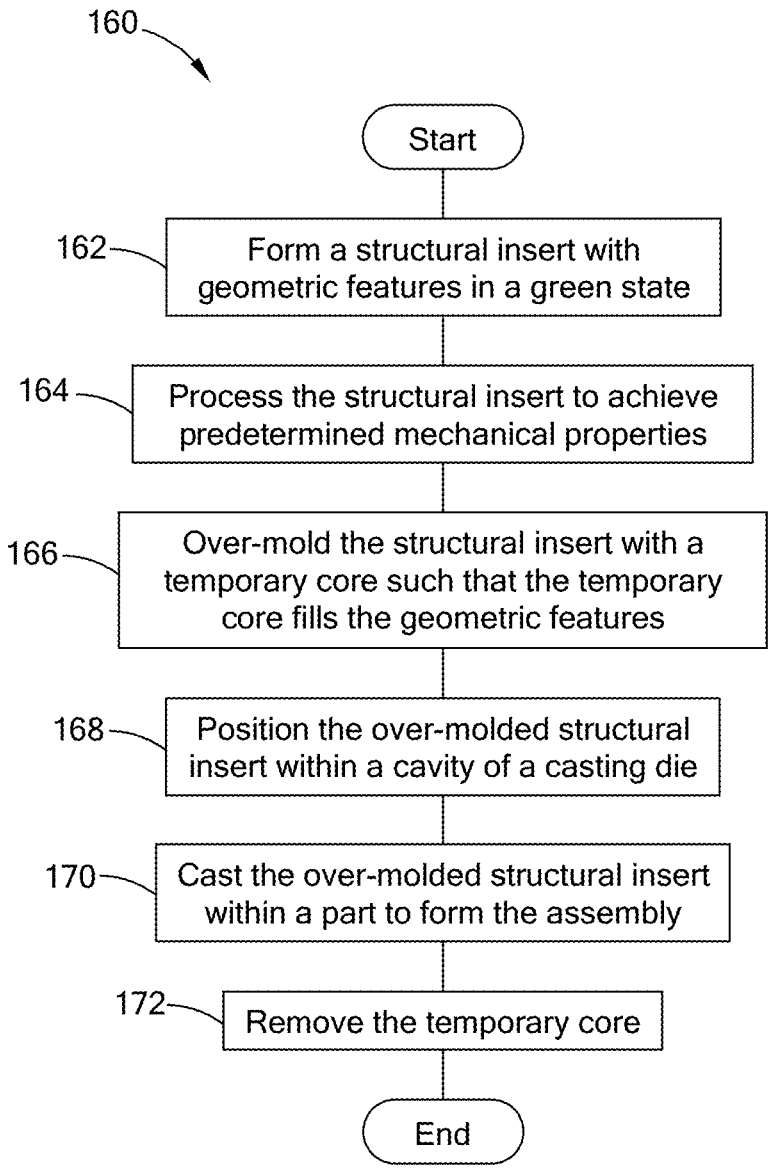
FIG. 8 is a flow chart illustrating another form of a method for casting an assembly, according to the teachings of the present disclosure.

Referring to FIG. 8, a method 160 of casting an assembly according to the teachings of the present disclosure is shown. The method 160 comprises forming a structural insert with geometric features in a green state 162, processing the structural insert to achieve predetermined mechanical properties 164, and over-molding the structural insert with a temporary core such that the temporary core fills the geometric features 166. The over-molded structural insert is positioned within a cavity of a casting die 168 and cast within a part to form the assembly 170 and the temporary core is removed 172.

In variations of these methods, the assembly is an engine block and the geometric features comprise a crank journal, an oil feed hole, bolt pilot holes, a thrust face, a face having a casting draft, and internal fluid passageways.

Figure 9:
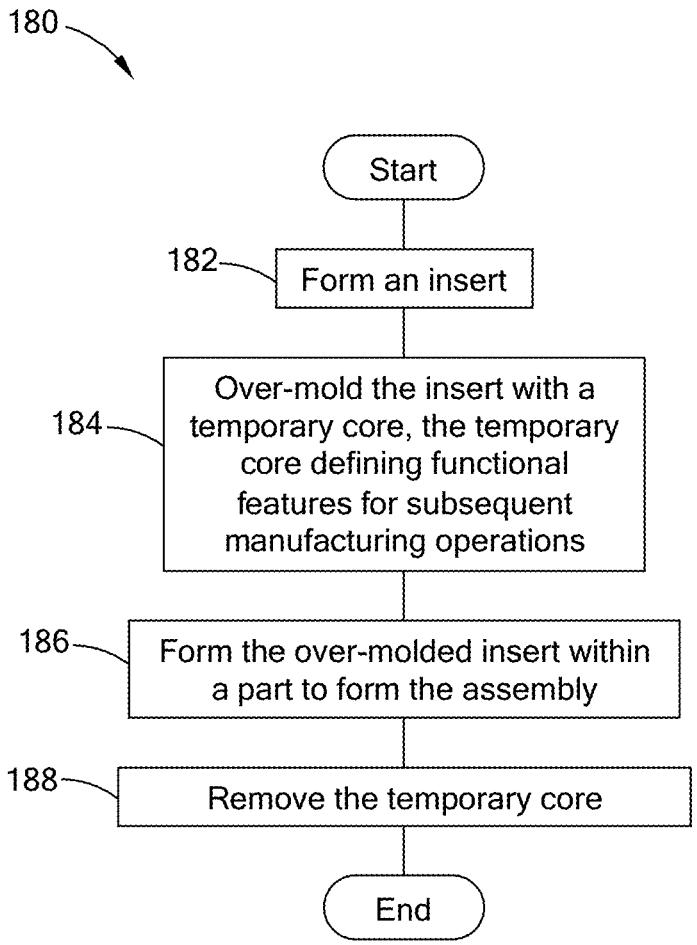
FIG. 9 is a flow chart illustrating yet another method for forming an assembly, according to the teachings of the present disclosure.

Referring to FIG. 9, a method 180 of forming an assembly according to the teachings of the present disclosure is shown. The method 180 comprises forming an insert 182 and over-molding the insert with a temporary core that defines functional features for subsequent manufacturing operations 184. Then the over-molded insert is formed within a part to form the assembly 186 and the temporary core is removed 188. In another method of the present disclosure, the insert does not undergo any post-processing to remove material after removing the temporary core.

The temporary core of the present disclosure is enabled to retain the insert during the casting processes (including transport, insertion, die closure, metal injection, etc.) reducing supplemental fixturing of the insert.

The present disclosure should not be limited to structural inserts, any cast part that could be improved by the teachings of the present disclosure are within the scope of the present disclosure. The present disclosure improves cast parts that desire machining for an assembly point (bearing surface, fastening location, contact surface, etc.), internal passage, and casting draft removal. The present disclosure improves cast parts when bi-metallic machining is otherwise required. Also, the present disclosure improves the net-shape casting of parts, reducing or negating post-processing steps beyond typical cast trim/finishing operations that require gross material removal (alloy or insert) to provide the desired cast part.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A method of casting an assembly comprising:

forming a structural insert;

over-molding the structural insert with a temporary core;

positioning the over-molded structural insert within a cavity of a casting die;

casting the over-molded structural insert within a part to form the assembly; and removing the temporary core wherein the part is an engine block, and the temporary core completely fills a crank journal of the structural part.

2. The method according to claim 1, wherein the temporary core further fills an oil feed hole within the structural insert.

3. The method according to claim 2, wherein the oil feed hole is formed in the structural insert in a green state, and the structural insert is subsequently processed to achieve predetermined mechanical properties.

4. The method according to claim 1, wherein the temporary core is configured to define an alloy flash trim location.

5. The method according to claim 1, wherein the casting comprises high pressure die casting (HPDC).

6. The method according to claim 1, wherein the structural insert is a steel alloy material.

7. The method according to claim 1, wherein the part is an aluminum alloy material.

8. The method according to claim 1, wherein the temporary core defines locating features to position the structural insert within the cavity of the casting die.

9. The method according to claim 1, wherein the structural insert does not undergo any post-processing to remove metal from the casting step after removing the temporary core.

10. The method according to claim 1, wherein the temporary core is soluble.

11. The method according to claim 1, wherein the temporary core defines shared features with the structural insert.

12. The method according to claim 1 further comprising a plurality of temporary cores configured to define at least one functional feature for subsequent manufacturing operations.

13. The method according to claim 1 further comprising a plurality of temporary cores and a plurality of structural inserts to form a plurality of over-molded structural inserts, wherein the plurality of over-molded structural inserts are cast within the part to form the assembly.

14. A method of casting an assembly comprising:

forming a structural insert with geometric features in a green state;

processing the structural insert to achieve predetermined mechanical properties;

over-molding the structural insert with a temporary core such that the temporary core fills the geometric features;

positioning the over-molded structural insert within a cavity of a casting die;

casting the over-molded structural insert within a part to form the assembly; and removing the temporary core.

15. The method according to claim 14, wherein the assembly is an engine block and the geometric features are selected from the group consisting of a crank journal, an oil feed hole, bolt pilot holes, a thrust face, a face having a casting draft, and internal fluid passageways.

16. The method according to claim 14, wherein the temporary core is configured to define an alloy flash trim location.

17. The method according to claim 14, wherein the temporary core defines locating features to position the structural insert within the cavity of the casting die.

* * * * *